US011534649B1

(12) United States Patent
O'Leary

(10) Patent No.: US 11,534,649 B1
(45) Date of Patent: Dec. 27, 2022

(54) FITNESS CHAIR AND METHOD OF USE

(71) Applicant: Robert W. O'Leary, Sayville, NY (US)

(72) Inventor: Robert W. O'Leary, Sayville, NY (US)

( * ) Notice: Subject to any disclaimer, the term of this patent is extended or adjusted under 35 U.S.C. 154(b) by 0 days.

(21) Appl. No.: 17/332,799

(22) Filed: May 27, 2021

Related U.S. Application Data

(60) Provisional application No. 63/031,225, filed on May 28, 2020.

(51) Int. Cl.

| | |
|---|---|
| ***A63B 21/055*** | (2006.01) |
| ***A63B 21/16*** | (2006.01) |
| ***A47C 9/00*** | (2006.01) |
| ***A47C 7/62*** | (2006.01) |

(52) U.S. Cl.
CPC ..... *A63B 21/0557* (2013.01); *A47C 7/62* (2013.01); *A47C 9/002* (2013.01); *A63B 21/1609* (2015.10)

(58) Field of Classification Search
CPC ... A63B 21/0557; A63B 21/1609; A47C 7/62; A47C 9/002
See application file for complete search history.

(56) References Cited

U.S. PATENT DOCUMENTS 5,234,394 A * 8/1993 Wilkinson ..... A63B 21/16 482/121
10,232,213 B1 * 3/2019 Smith, Jr. ..... A63B 21/0442
2007/0099780 A1 * 5/2007 Bowser ..... A63B 21/00043 482/148
2007/0111869 A1 * 5/2007 Wallach ..... A63B 21/4043 482/121
2008/0119333 A1 * 5/2008 Bowser ..... A63B 21/156 482/62
2010/0041526 A1 * 2/2010 Bowser ..... A63B 23/1209 482/123
2012/0322633 A1 * 12/2012 Holman ..... A63B 21/0555 482/123
2013/0157818 A1 * 6/2013 Lalaoua ..... A63B 21/152 482/123
2017/0216649 A1 * 8/2017 Lalaoua ..... A63B 23/03575
2019/0351279 A1 * 11/2019 Carney ..... A63B 21/0442
2020/0114194 A1 * 4/2020 McGhee ..... A63B 21/169

* cited by examiner

*Primary Examiner* — Andrew S Lo
(74) *Attorney, Agent, or Firm* — Leavitt Eldredge Law Firm

(57) ABSTRACT

A fitness chair for utilizing exercise resistance bands for a safe full body workout is disclosed. The fitness chair includes a chair frame having a seat member and a backrest member; a first hollow member coupled to the chair frame, the first hollow having a first exercise resistance band passing therethrough; a base frame engaging with the chair frame via one or more chair legs, the base frame having a second hollow member and a third hollow member running parallel therebetween, the second hollow member having a second exercise resistance band passing therethrough, and the third hollow member having a third exercise resistance band passing therethrough.

2 Claims, 3 Drawing Sheets

FITNESS CHAIR AND METHOD OF USE

CROSS REFERENCE TO RELATED APPLICATIONS

This application claims the benefit of U.S. Provisional Application 63/031,225, filed May 28, 2020, of which is hereby incorporated by reference in its entirety.

BACKGROUND

1. Field of the Invention

The present invention relates generally to fitness systems, and more specifically to a fitness chair that utilizes exercise resistance bands secured thereto and enables a user to perform various exercises while using the fitness chair.

2. Description of Related Art

Fitness systems are well known in the art and are effective means to reduce health risks associated with many chronic diseases. Common fitness systems include various fitness equipment such as treadmills, stationary bicycles, bench presses, pulleys, and such that facilitate various exercises. Unfortunately, however, many individuals have difficulty in using current fitness equipment due to a general lack of fitness, lack of mobility, or the like. Such persons include the elderly, obese, and otherwise physically challenged individuals.

Therefore, it would be advantageous to have an apparatus that enables a user of any fitness level to perform a full body workout while in a sitting, standing, or lying position.

Accordingly, although great strides have been made in the area of fitness systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1A:
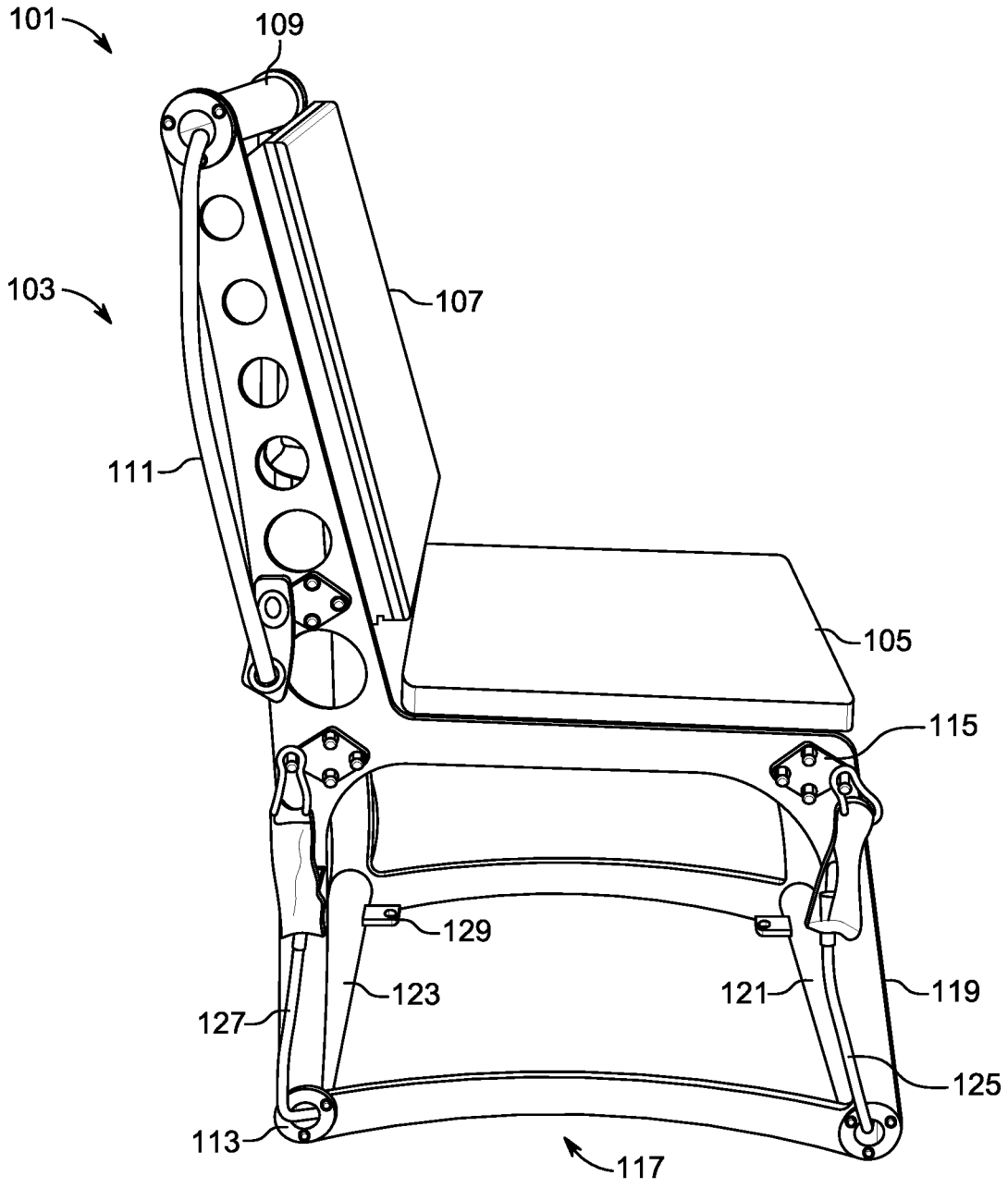
FIG. 1A is a profile view of a fitness chair in accordance with a preferred embodiment of the present invention.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional fitness systems. Specifically, the present invention provides for a fitness chair that enables a user to perform various exercises while using the fitness chair. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 1B:
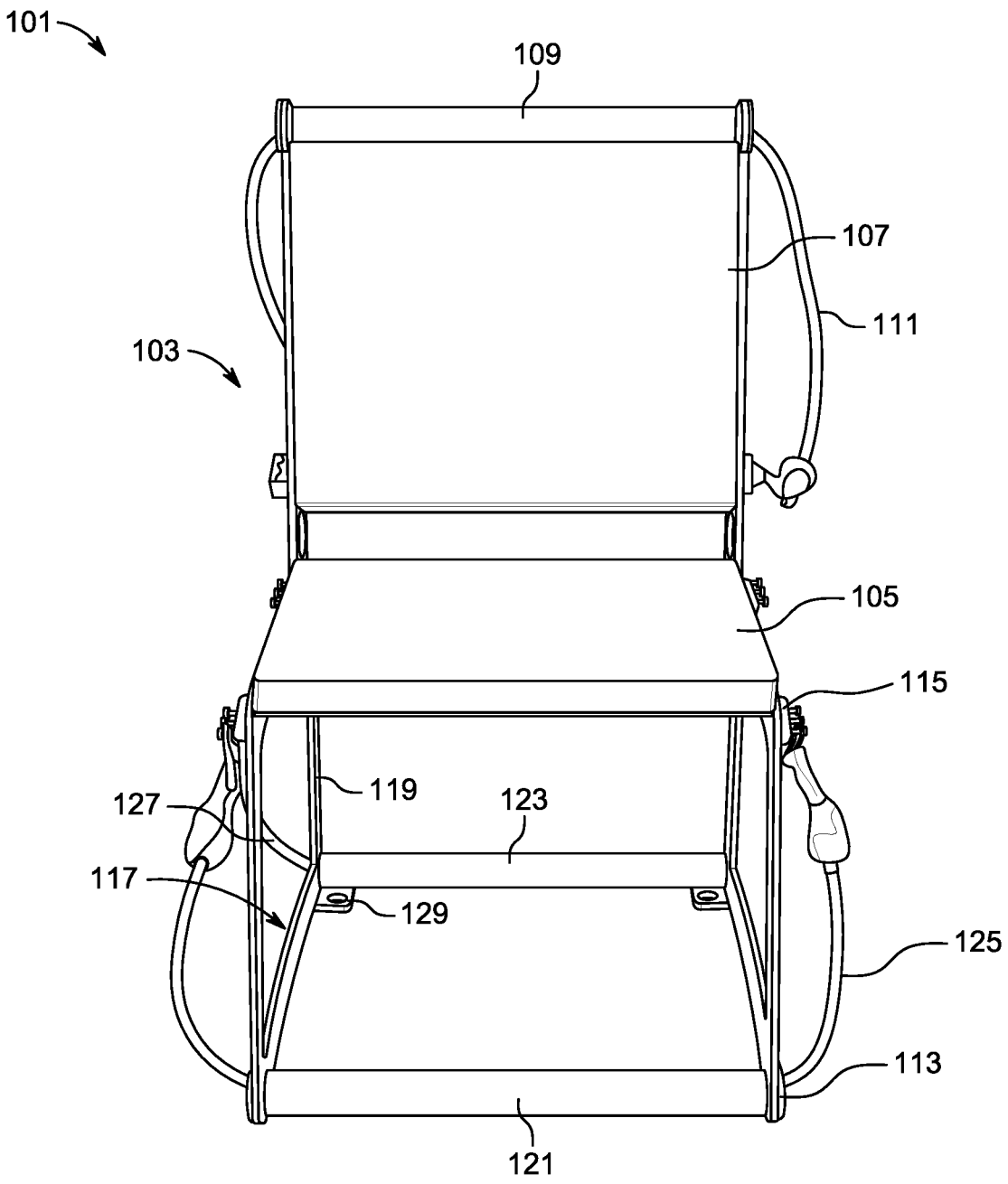
FIG. 1B is a front view of a fitness chair in accordance with a preferred embodiment of the present invention.

Referring now to the drawings wherein like reference characters identify corresponding or similar elements throughout the several views, FIGS. 1A-1B depict a profile view and a front view, respectively, of a fitness chair 101 in accordance with a preferred embodiment of the present application. It will be appreciated that the fitness chair 101 overcomes one or more of the above-listed problems commonly associated with conventional fitness systems.

In the contemplated embodiment, the fitness chair 101 includes a chair frame 103 having a seat member 105 and a backrest member 107 secured thereto. The chair frame 103 is configured to support a person thereon. The chair frame 103 also includes a first hollow member 109 coupled to a top portion of the chair frame 103. The first hollow member 109 is configured to allow a first exercise resistance band 111 to pass therethrough. The opposing ends of the first hollow member 109 include low friction inserts 113 for improved durability. In addition, the opposing ends of the first exercise resistance band 111 removably couple to the chair frame 103 via one or more rope clips 115.

The fitness chair 101 also includes a base frame 117 engaging with the chair frame 103 via one or more chair legs 119. The base frame 117 includes a second hollow member 121 and a third hollow member 123 running parallel from one another. The second hollow member 121 is configured to allow a second exercise resistance band 125 to pass therethrough. The opposing ends of the second exercise resistance band 125 removably couple to a bottom portion of the chair frame 103 via one or more rope clips 115. In addition, the opposing ends of the second hollow member 121 include low friction inserts 113 for improved durability.

The third hollow member 123 is configured to allow a third exercise resistance band 127 to pass therethrough. Additionally, the opposing ends of the third hollow member 123 include low friction inserts 113 for improved durability. Further, the opposing ends of the third exercise resistance band 127 removably couple to a bottom portion of the chair frame 103 via one or more rope clips 115.

The fitness chair also includes one or more anchor plates 129 coupled to the base frame 113. The one or more anchor plates 129 allow the user to secure the fitness chair 101 to a floor surface via any attachment means including, without limitation, bolts, screws, nails, other fasteners, and the like.

It should be appreciated that the exercise resistance bands 111, 125, 127 may be formed of any material such as bungee cord and stock cord. Additionally, the exercise resistance bands 111, 125, 127 may have the same or different level resistance as well as color coding or other labeling to indicate the level of resistance.

It should also be appreciated that the fitness chair 101 may vary based on aesthetical, functional, or manufacturing considerations.

It should also be appreciated that one of the unique features believed characteristic of the present application is that it provides a safe and secure fitness equipment that allows the user to perform a full body exercise routine while in a standing, sitting, or lying position.

Figure 2:
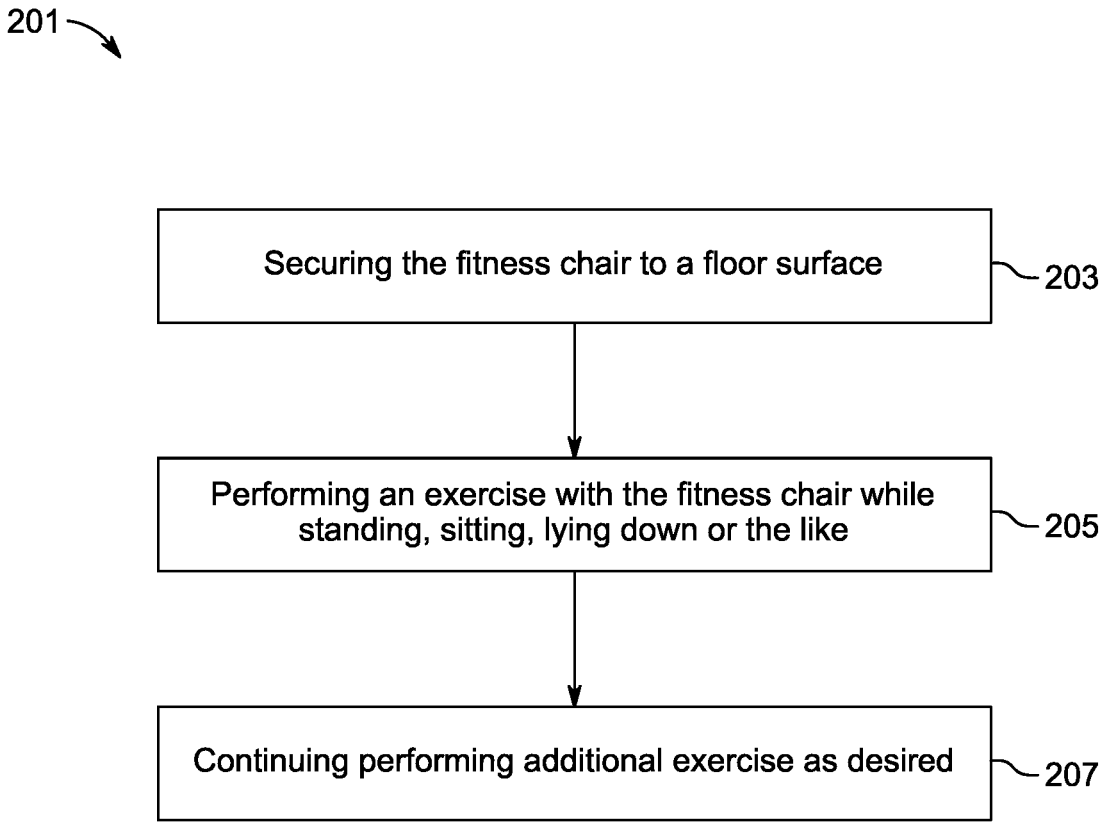
FIG. 2 is a flowchart of a method of use of the fitness chair of FIGS. 1A and 1B.

In FIG. 2, a flowchart 201 depicts a simplified method of use associated with the fitness chair 101. During use, when the fitness chair is secured to a floor surface, the user may perform an exercise with the fitness chair while standing, sitting, laying down or the like, as shown with boxes 203, 205. The user may continue performing additional exercises as desired, as shown with box 207.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A fitness chair, comprising:

a chair frame having a seat member and a backrest member secured thereto, the chair frame configured to support a person thereon;

a first hollow member having opposing ends with low friction inserts, the first hollow member coupled to a top portion of the chair frame, the first hollow member configured to allow a first exercise resistance band to pass therethrough;

a base frame engaging with the chair frame via one or more chair legs, the base frame having:

a second hollow member having opposing ends with low friction inserts, the second hollow member configured to allow a second exercise resistance band to pass therethrough; and a third hollow member having opposing ends with low friction inserts, the third hollow member configured to allow a third exercise resistance band to pass therethrough;

wherein the second hollow member and the third hollow member run parallel;

one or more rope clips configured to removably couple opposing ends of the first exercise resistance band, second exercise resistance band, and the third exercise resistance band to the chair frame; and one or more anchor plates engaging with the base frame, the one or more anchor plates allowing for secure coupling of the fitness chair to a floor surface.

2. A method of exercise, the method comprising:

providing a fitness chair, the fitness chair comprising:

a chair frame having a seat member and a backrest member secured thereto, the chair frame configured to support a person thereon;

a first hollow member having opposing ends with low friction inserts, the first hollow member coupled to a top portion of the chair frame, the first hollow member configured to allow a first exercise resistance band to pass therethrough;

a base frame engaging with the chair frame via one or more chair legs, the base frame having:

a second hollow member having opposing ends with low friction inserts, the second hollow member configured to allow a second exercise resistance band to pass therethrough; and a third hollow member having opposing ends with low friction inserts, the third hollow member configured to allow a third exercise resistance band to pass therethrough;

wherein the second hollow member and the third hollow member run parallel;

one or more rope clips configured to removably couple opposing ends of the first exercise resistance band, second exercise resistance band, and the third exercise resistance band to the chair frame; and one or more anchor plates engaging with the base frame, the one or more anchor plates allowing for secure coupling of the fitness chair to a floor surface securing the fitness chair to a floor surface;

performing an exercise with the fitness chair while standing, sitting, or lying down; and continuing to perform additional exercises as desired.

* * * * *